US005690337A

United States Patent [19]

Somma et al.

[11] Patent Number: 5,690,337

[45] Date of Patent: Nov. 25, 1997

[54] BETTING GAME APPARATUS AND METHOD OF PLAY

[76] Inventors: Joseph D. Somma, 3001 Lake East Dr., Bldg. 14, Apt. 2110, Las Vegas, Nev. 89117; Philip A. Romeo, 3374 Racquet St., Las Vegas, Nev. 89121

[21] Appl. No.: 632,903

[22] Filed: Apr. 16, 1996

[51] Int. Cl.[6] ..... A63F 1/00

[52] U.S. Cl. ..... 273/309; 272/292

[58] Field of Search ..... 273/309, 292

[56] References Cited

U.S. PATENT DOCUMENTS

| | | | |
|---|---|---|---|
| 3,236,362 | 2/1966 | Hackbarth et al. . | |
| 3,998,462 | 12/1976 | Goott . | |
| 4,651,997 | 3/1987 | Wood . | |
| 5,098,107 | 3/1992 | Boylan et al. | 273/309 X |
| 5,184,821 | 2/1993 | Korenek . | |
| 5,265,881 | 11/1993 | Doherty . | |
| 5,308,081 | 5/1994 | Bartle . | |
| 5,350,175 | 9/1994 | DiLullo et al. . | |
| 5,417,430 | 5/1995 | Breeding | 273/309 X |
| 5,431,407 | 7/1995 | Hofberg et al. . | |
| 5,544,893 | 8/1996 | Jones et al. | 273/309 |

*Primary Examiner*—William H. Grieb
*Attorney, Agent, or Firm*—John C. Lambertsen

[57] ABSTRACT

A method and apparatus for playing a casino card game is disclosed that utilizes a single, 41-card deck of playing cards consisting of a standard, 4-suit playing card deck from which all "face" cards have been removed and a single "joker" card has been added. Play of the game starts with a first player selecting a card value, termed the "dealer number". No bets can be placed on the dealer number. Players may then place their wagers(s) on any of the remaining "live" numbers, and the dealer deals a first playing card, face up. If the identified "dealer number" card value is turned over, all players having placed a bet on any of the "live" numbers win, and are paid off even money. If the card has a value other than the "dealer number", the house wins all bets placed on the "value" number of the card that was turned over, and that value number is thereafter considered "dead". Play continues, with the players given an opportunity to place additional bets on the remaining, "live" card values prior to turning over the next card. If the "joker" card is dealt by the dealer at any time before the "dealer number" has been dealt, the house wins all remaining bets, and the game is over. The present invention also contemplates the placement of proposition bets.

21 Claims, 1 Drawing Sheet

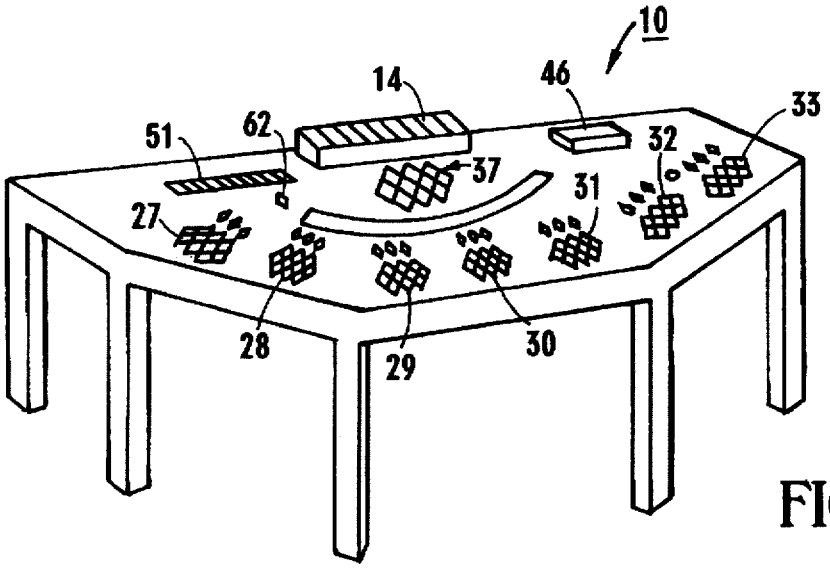
FIG. 1
FIG. 2
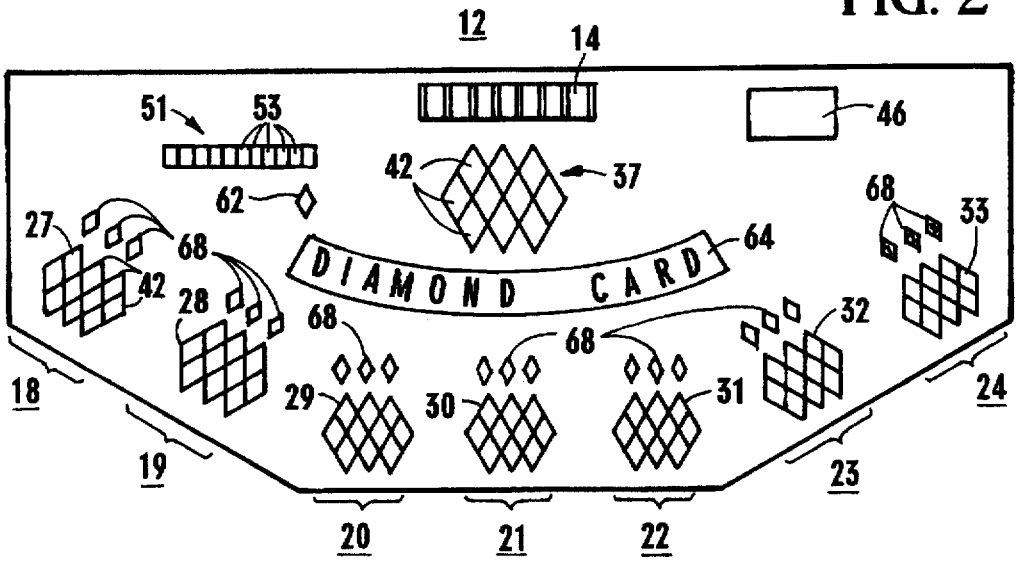
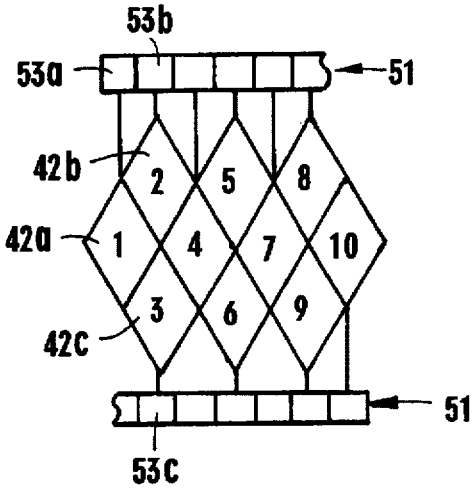
FIG. 3

BETTING GAME APPARATUS AND METHOD OF PLAY

FIELD OF THE INVENTION

The present invention relates generally to a casino card game, and more particularly, to a card game that is played against a casino, with easily understood rules, and which includes the opportunity for players to place multiple wagers on various possible outcomes at each play of the cards.

BACKGROUND OF THE INVENTION

Casino gambling in the late 1980's, and through the 1990's, has experienced explosive growth. Casinos have increased both in number and in size, resulting in greater pressures to attract new players to casino gaming. This requires both new variations on the cash promotions and complimentary benefits used to attract first and second time visitors, as well as the development of new games to make the visitor a regular customer.

Casino gaming is now being promoted as an acceptable and viable form of entertainment, rather than as gambling per se. These new casino games can no longer rely solely upon the possibility of very large payoffs to create bettor interest. In addition to being both interesting and exciting to play, to attract this new type of customer, the new casino games must be extremely easy for a player to understand.

The traditional casino games vary widely both in complexity of the rules and in the skill level required if the player is to meaningfully participate in the game. In an attempt to create a skill-building ladder, casinos have offered games of varying complexity, permitting the players to advance from the simple games to the more complex. The greater involvement of the players in the complex games is perceived by the casinos to result in increased wagering amounts.

As a first step, the novice player will typically use single-play slot machines as his or her introduction into gambling. Winning or losing is entirely the result of a random selection by the slot machine itself. A player need only pull a lever (or push a button) and watch as the whirring numbers and symbols gradually ratchet to a stop. If the resulting combination on the payoff line is defined to be a "winning" combination, a payoff results.

This machine-player interaction is entirely non-threatening, and is usually sufficient to engage players that are new to the concept of gambling. However, for many players, the interest in slot machines rapidly wanes, since there is absolutely no skill involved on the part of the player.

This lack of participation was addressed, very successfully, with the advent of the video poker machines. As the winner of an increasingly greater amount of casino floorspace (at the expense of the single-play slots). Video poker provides the player with an option of selecting the number of cards to draw, and which cards to discard. While video poker may not provide the full range of attributes provided by draw poker, it is played in a considerably less-threatening environment.

Most novice gamblers are introduced to casino card games by playing low-limit blackjack. Having basic rules that are relatively simple to understand, blackjack permits players to quickly learn a game that requires social interaction between the player and a dealer, in a community setting that involves other players. Blackjack also permits a player to participate both in the play of the game as well as in the matter of making wagers. While a degree of luck is required to win, skill enhancement is encouraged, since a player with a better understanding of the game, particularly the odds of winning, is able to appreciably enhance his or her chances for success.

The card game of poker has long been associated with casinos, however it has never attained anything other than a very modest level of popularity. In the traditional card game of poker, the house (casino) does not actually participate in the game, but rather typically only receives a fee in exchange for its services in providing tables for play and a non-playing dealer. Other than in the context of promoting poker tournaments, and creating a spectator event, there has been little incentive for casinos to actively promote the playing of poker.

More importantly, the majority of casino players do not look upon poker as "entertainment". This is not a "friendly" game played in someone's home, among friends, on a Friday or Saturday night—nor is it being played against the "house". Instead, each player is playing against the others at the table. Winners take money from the "losers"—namely, persons sitting at their same table. While no longer the life-threatening game it may have been in the old west, in a game where the winners bluff money from the losers, hard feelings are frequently the result. Such feelings are not associated by most persons with having a good time and being entertained.

Perhaps the most "exciting" casino game is the game of craps. Utilizing a pair of dice instead of playing cards, craps provides a number of different bets, and encourages player participation. Moreover, it is a very social form of participation, which tends to attract crowds of increasing size as the game progresses. Unfortunately, the great number of possible bets and side bets convinces a novice that craps is a very complicated game. The fast paced action of a craps game exacerbates the problem by creating a poor learning environment, one that is extremely intimidating for those players not already familiar with the game rules. The majority of craps players learned the game during a tour of duty in the armed forces or on the street corners. As a result, casinos recognize that there are fewer new players joining the ranks as the older players retire. A further disadvantage of the game of craps is that it involves the use of dice. The majority of novice gamblers are not as familiar with dice as they are with playing cards, causing some degree of discomfort. Casinos are equally leery, since the handling of the dice by the individual players presents an increased risk of cheating.

Ideally it would be desirable to devise a casino card game having the interesting and challenging attributes of craps, presenting a variety of wagering options, including the ability to make wagers between plays of the game, and wherein such a game would play equally well with different numbers of players—all of the players playing against the "house" or casino. It would also be desirable to incorporate the positive attributes of the game of blackjack, where only the dealer makes contact with the playing cards and the rules of play are very simple and easily understood.

SUMMARY OF THE INVENTION

In accordance with the present invention, a method and apparatus for playing a wagering game are provided. A casino card game is disclosed that utilizes a single, 41-card deck of playing cards. This specialized deck of cards consists of a standard, 4-suit playing card deck from which all "face" cards ("jack", "queen, and "king") have been removed and a single "joker" card has been added.

Play of the game starts with a first player selecting a card value from the range "ACE" through "TEN". This card value is termed the "dealer number", and it is somewhat analogous to the number defined by the first roll of the dice in the game of craps. The selected "dealer number" is then considered "dead", i.e., no bets can be placed thereon, and the players may then place their wagers(s) on any of the remaining "live" numbers, "ACE" through "TEN".

After all bets are placed, the dealer deals a first playing card, face up. If the identified "dealer number" card value is turned over, all players having placed a bet on any of the "live" numbers win, and are paid off even money. The game concludes, and the playing card deck is reshuffled in preparation for the next game. In a preferred version of this game, should the "dealer number" value be turned over, and the playing card is in the "diamonds" suit, all players having placed a bet are paid at an enhanced odds, 1.5 to 1.

Alternatively, if the first card dealt has a value other than the "dealer number", the house wins all bets placed on the "value" number of the card that was turned over, and that value number is thereafter considered "dead", i.e., not eligible to receive any further bets during that particular game. Play then continues, with the players given an opportunity to place additional bets on the remaining, "live" card values prior to turning over the next card.

Finally, if the "joker" card is dealt by the dealer at any time before the "dealer number" has been dealt, the house wins all remaining bets, and the game is over. Absent dealing of the joker card, play continues until the "dealer number" is dealt. At that time, the game is complete, the deck of cards is reshuffled, and a new dealer number is selected.

It is therefore an object of the present invention to provide a card game that is entertaining to play and that utilizes rules that are simple and straight-forward to understand.

It is still another object of the present invention to provide such a card game in which a player plays against the house, rather than another player.

In addition to the primary game discussed above, the present invention also contemplates the placement of proposition bets by any one or all of the players. Prior to the dealer turning over the first card, any player can make a separate, proposition wager that the first card will be the ACE of diamonds. Should that card be dealt first, all players having made such a proposition bet will win, and then be provided with an opportunity to either collect an enhanced payoff, or to wager all of the enhanced payoff on a bet that the second dealt card will be the TWO of diamonds. If at least one of the proposition bet players makes such a wager, and in fact the TWO of diamonds is then dealt, all winning proposition bet players will then be accorded the option of either collecting a super-enhanced payoff or placing a final proposition bet, wagering all of such super-enhanced payoff on the proposition that the next card dealt will be the THREE of diamonds. If the THREE of diamonds card is then turned over, the proposition betting concludes with a greatly-enhanced payoff for each successful player.

The card game of the present invention is preferably played on a table layout specifically designed for the game. The table layout includes indicia representing each of the possible card bets, along with an indicator system for identifying the "dealer number" and the numbers remaining available for betting as the game progresses. Because of its simplicity, the game in accordance with the present invention can also be programmed to play on a video terminal.

Some further objects and advantages of the present invention shall become apparent from the ensuing description and as illustrated in the accompanying drawings.

BRIEF DESCRIPTION OF THE DRAWINGS

FIG. 1 is a perspective view showing a gaming table constructed in accordance with the principles of the present invention;

FIG. 2 is a diagrammatic plan view of a typical playing surface layout for the card game described by the present invention; and FIG. 3 is a schematic view illustrating the electrical communication between an array of light switches and a selectively illuminated player betting area in accordance with the present invention.

DETAILED DESCRIPTION OF THE PREFERRED EMBODIMENTS

As used in this specification the term "casino card game" refers to a card game in which the casino or "house" acts as the banker, collecting all losing wagers and paying all winning wagers. The casino is the "dealer" of the game, and individual players play against the casino and not against one another.

The card game of this invention is played with a deck of cards, and preferably a modified standard deck of cards. Comprising four sets or suits of cards, namely SPADES, HEARTS, DIAMONDS, and CLUBS, in each suit there are ten cards that are numerically arranged from "ACE" (or one) to "TEN". In addition, the deck includes a "JOKER" or other "special" card that is unrelated to any of the other cards or suits.

The particular denomination of the cards, i.e., its numeric indicia, has no particular intrinsic value with respect to the card game of the present invention, other than with respect to the placement of the playing card in the card sequence. Additionally, except for certain wagering features associated with the "diamonds" suit, the suit designation also does not enter into the play of the game. Finally, although the play of the game will be illustrated by making reference to a specific game layout, it should be understood and appreciated that the game of the present invention can be played with a different layout or without the use of a layout and still be within the scope of the present invention.

Reference is now made to the drawings wherein like numerals refer to like parts throughout. Referring to FIG. 1, there is shown a gaming table constructed in accordance with the principles of the present invention and designated generally by reference numeral 10. In one preferred embodiment, the gaming table 10 is generally semi-circular in shape, with a series of linear segments that generally approximate a semi-circular arc. The gaming table 10 is preferably sized to have approximately the same dimensions as a conventional casino gaming table of the type normally used to play blackjack. Alternatively, when a lower-style table is desired, one having dimensions similar to those used to play pai gow is preferably used.

A dealer position 12 is located at the center along the linear, rear edge of the gaming table 10 (best shown in FIG. 2). An area is provided immediately adjacent the dealer position 12 for placement of a chip tray 14. Casino games are typically played using chips rather than actual currency, and the chip tray 14 is used by a dealer as a bank, holding chips to pay winning wagers and receiving chips from losing bets. A plurality of playing positions 18, 19, 20, 21, 22, 23, 24 (best shown in FIG. 2) are spaced around the arcuate portion of the gaming table 10.

Immediately proximate each of the playing positions 18–24 are located a respective player betting area 27, 28, 29, 30, 31, 32, 33. Each of the player betting areas 27–33 defines an area for placement of wagers by each player, as well as identifying the nature of the wager placed. The number of playing positions and associated player betting areas is determined by the number of players a dealer can effectively service, with a maximum of seven players a preferred number.

Displayed in front of the chip tray 14 is a betting array 37 that provides an enlarged representation of each of the player betting areas 27–33. In the preferred embodiment of the invention, the betting array 37 is further divided into a plurality of individual wagering fields 42. Each of the wagering fields 42 of the betting array 37 corresponds to a similar wagering field located in each of the player betting areas 27–33. As best illustrated by FIG. 3, each of the individual wagering fields 42 is provided with a separate indicia representing one out of the sequence of playing card values ranging from "ACE" to "10".

The card game of the present invention preferably uses a deck of playing cards having the sequence of from ACE, TWO, THREE, FOUR, FIVE, SIX, SEVEN, EIGHT, NINE, TEN, and "JOKER". Such an "ACE"—"TEN" sequence is preferably provided in each of the conventional suits, i.e., spades, hearts, diamonds, and clubs. After shuffling, and just prior to the play of the game, a deck including such specified playing cards is preferably placed in a dealing shoe 46. Such shoes are used in the majority of casino card games, making it much more difficult for the mis-handling of playing cards, whether deliberate or inadvertent.

As will be described more completely hereinafter, during the play of the casino card game in accordance with the present invention, one or more of the individual wagering fields 42 can become "dead", precluding the placement of further wagers upon such so-identified wagering fields. Since the "dead" values vary from game-to-game, in a preferred embodiment of the present invention, a visual indicator is provided to identify which of the wagering fields 42 that remain "alive" as the game progresses.

In a preferred embodiment of the present invention, each of the individual wagering fields 42 are provided with a selectively illuminated light source (not shown). Activation of such individual light sources is controlled by a light switching panel 51, consisting of a plurality of individual light switches 53. As best shown by reference to FIG. 3, each of the individual light switches 53 of the light switch panel 51 is operatively connected to and controls the illumination for a specific individual wagering field 42 in each of the player betting areas 27–33. For example, activation of the "ACE" light switch **53*a* activates the illumination source for the "ACE" wagering field 42*a* in each of the player betting areas 27–33**.

Returning to FIG. 2, play of the casino game in accordance with the present invention also requires identification of a specific wagering field, and a movable marker 62 is provided. Finally, in a preferred embodiment an identification field 64 is provided on the playing surface, providing a location upon which the identity of the casino game, here, "DIAMOND CARD™", can be displayed.

The play of the casino card game of the present invention preferably utilizes a single, shuffled, 41-card deck. As previously discussed, this deck of cards consists of the traditional four suits: SPADES, HEARTS, CLUBS, and DIAMONDS, and includes the sequence of cards ranging from "ACE" to "TEN" for each suit. A single "JOKER" card also is included in the deck. In a similar manner for most casino card games, it is preferred that the shuffling of the card deck is done with a mechanical shuffling device to further reduce the opportunities for cheating.

The game begins by a first player picking up the movable marker 62 and placing it on one of the individual wagering fields 42 of the betting array 37. The playing card represented by that particular wagering field, which now lies underneath the marker 62, is thereby identified as the "dealer number" and each wagering field in the player betting areas 27–33 that bears indicia for this card is considered to be "dead", i.e., ineligible for wagering. In a preferred embodiment, the appropriate light switch 53 on the light switch panel 51 is activated to shut off the light source and darken that particular wagering field for each player.

The players now place their wagers on each "eligible" or "alive" wagering field. The first game card is then drawn and turned over, with three possible wagering outcomes resulting therefrom: (1) the "JOKER" card is selected; (2) the "dealer card" is selected; or (3) a playing card of another number is selected. With respect to the "JOKER" card, if at any time the dealer turns over the "JOKER" card prior to the dealer turning over the "dealer card", the house automatically wins all placed bets, regardless of the card value bet, and the game is over.

If the dealer turns over the "dealer number", the players are paid, on an even money basis, for all wagers still remaining on the player betting area, and the game is concluded. Alternatively, if the dealer turns over a playing card that is not the "JOKER" nor the "dealer card", the house wins all of the bets that had been placed on the betting area for that particular card value. The wagering field for that card value or number is now considered "dead", and its respective light source is inactivated. Play then continues, with time for additional bets to be placed by the players on the remaining "alive" values. After all additional bets are placed, a further card is turned over. Play continues on this basis, with an ever-diminishing number of eligible wagering fields, until the dealer turns over either the "JOKER" card or the "dealer card".

In a further preferred embodiment of the present invention, a distinction is made between playing cards belonging to the suit of "DIAMONDS" and the remaining suits. In such a case, if the dealer turns over the "dealer card" and that card is in the suit of diamonds, the wager payoff is enhanced, with all players paid one-and-one-half the amount of the original wager. The "dealer card" under such rules is termed the "DIAMOND CARD™".

In a still further embodiment of this invention, proposition betting is provided as a wagering enhancement. Turning once again to FIG. 2, a series of propositional fields 68 are provided adjacent each of the player betting areas 27–33. In a preferred embodiment, each of the propositional fields 68 are provided a separate number of individual fields, sequentially ranging from 1 to 3. That propositional field 68 identified by the indicia "1" may receive a wager only before the first card of the game is dealt. Thereafter, that propositional wager area is considered to be "dead", and, as is more fully discussed below, the propositional fields 68 having indicia "2" and "3" are only available to the successful propositional bettor of the previous wager.

Prior to turning over the first card of a game, any player desiring to make a proposition bet wager so indicates by placing the wager in the propositional field 68 having the indicia "1". If the first card turned over by the dealer is an "ACE" of diamonds, that propositional wager wins, and all winning players are eligible for an enhanced payoff. Each winning propositional bet player then has two options: the player can either collect this enhanced winnings, thereby precluding any further propositional wagering by that player until the beginning of a new game, or the player can place all of such enhanced winnings on the propositional field 68 identified by the numeral "2". If the player elects the latter option, the dealer then turns over the second card. If that second card bears the numeral "2", and is in the "diamond"

suit, all properly placed second-level propositional bets win, with a further-enhanced payoff available to the winning proposition bet players.

Each second-level winning player again has the option of either collecting this further-enhanced payoff, concluding further propositional bet participation, or placing such further-enhanced payoff on the propositional field 68 identified by the numeral "3". If this latter option is elected, the dealer then turns over a third card. If such third card bears the numeral "3" and is in the suit identified as "diamond", all properly placed third-level propositional bets win and those players receive a super-enhanced payoff amount.

It is to be understood that any other playing cards turned over by the dealer during this sequence of propositional bets causes a "loss" of the propositional bet wager. Further, should the "ACE" be initially selected as the "dealer card" or "diamond" card, its subsequent selection as the first dealt card would result in the game concluding. However, when a propositional bet is on the table, the regular game concludes while the propositional sequence as just described continues until it has concluded-either due to the collection of the payoff amount by the player(s) or the turning over of a losing card.

The actual playing odds of the card game in accordance with the present invention, including the extent to which a sequence of wagering fields will be eliminated prior to obtaining a match with the "dealer card" are readily calculated using well-known techniques. Further, the odds paid for each type of wager will be set by the individual casino depending upon the particular rate of return desired for the card game.

As can be readily understood and appreciated, the play of the card game of the present invention is interesting and challenging to both experienced and novice card players. The rules of play are simple and straight forward, permitting them to be easily understood by players with no prior gaming experience. Additionally, play of the card game in accordance with the present invention has many similarities to the game of craps. The card game play starts with the selection of a specific point value, in the present game by the choice of a player rather than the initial roll of the dice, and the players are then presented with the possibility of a number of plays (cards dealt) until a match to the selected card is made. Since the odds favor a sequence of play prior to such a match being made, this card game provides the opportunity for players to make multiple wagers during play of the game. The propositional bets provide a further enhancement to the game of the present invention, permitting those players to make wagers in an effort to obtain greatly-enhanced payoff amounts.

The card game thus described is also suitable for play on a video terminal, if desired. Without any required changes or modifications in the rules of play, a gaming device can be provided that permits play of the present game by persons who would rather play against a machine, or who desire to initially try the game in private rather than in the presence of other players.

The present invention has been described with respect to specific embodiments thereof. It will be well understood that various changes and modifications may be suggested to one skilled in the art. It is intended to encompass such changes and modifications as fall within the scope of the claims. The scope of the present invention is not to be viewed as limited to the embodiments described herein, but rather to the scope of the present invention as defined by the claims.

We claim:

1. A game apparatus used in combination with a deck of playing cards and in which one or more persons can participate as players and one person is to act as a dealer, comprising:

a playing surface;

a portion of the surface adjacent the periphery thereof having thereon a plurality of player betting areas at space locations where each player is to be stationed during a game;

means associated with the playing surface at each of said plurality of player betting areas for designating a numbered array, each number in each said numbered array corresponding to a numeric value defined by a separate playing card taken from said deck of playing cards, such that said numbered array includes all possible numeric values in said deck of playing cards;

means associated with the playing surface for selectively identifying a specific one of said numbers in each of said numbered arrays, said selective identification dependant upon either numeric values chosen by a player or numeric values corresponding to the numeric value of a playing card as such is revealed when turned over by the dealer.

2. A game apparatus as described in claim 1, wherein said deck of playing cards comprises four separate suits, with each suit including individual cards bearing numeric values of "1", "2", "3", "4", "5", "6", "7", "8", "9" or "10".

3. A game apparatus as described in claim 2, wherein said deck of playing cards includes a special card having no numeric value.

4. A game apparatus as described in claim 3, wherein said special card is a "joker".

5. A game apparatus as described in claim 3, wherein each of said numbered arrays have defined within a sequence of wagering fields and said sequence of wagering fields are marked consecutively as "1", "2", "3", "4", "5", "6", "7", "8", "9", and "10" so that each player can place a wager on a respectively numbered wagering field based upon a guess by that player as to a card value not yet turned over by the dealer.

6. A game apparatus as described in claim 5, and further comprising:

a selectively illuminated light source provided each of said betting positions; and a sequence of light switches, each of said light switches operatively connected to a light source for a particular wagering field in each of said player betting areas.

7. A game apparatus as described in claim 1, and further comprising:

means associated with the playing surface for designating a second series of defined areas located at each of said plurality of player betting areas and corresponding to certain specific playing cards.

8. A game apparatus as described in claim 7, wherein said second series of defined areas is designated as a propositional betting field.

9. A game apparatus as described in claim 8, wherein each of said propositional betting fields comprises a three-member array.

10. A game apparatus as described in claim 9, wherein each of said there-member arrays is marked consecutively as "1", "2", and "3", so that each player can place a wager on a respectively numbered propositional betting field based upon a guess by that player as to a sequence of card values to be turned over by the dealer.

11. A game apparatus as described in claim 10, wherein said sequence of card values are the first, second, and third cards to be turned over by the dealer at the start of each game.

12. An apparatus for playing a wagering game whose outcome is determined by chance, comprising;

a plurality of symbols for the game that are randomly selected;

a playing surface having a plurality of player betting areas defined thereon, each of said player betting areas having a plurality of individual wagering fields, each individual wagering field including indicia representing a separate one of said plurality of symbols;

a marker that may be used by a player to selectively identify a specific symbol out of said plurality of symbols;

a display for identifying said specific symbol selectively identified by said marker and such symbols of said plurality of symbols as are sequentially, randomly selected during the play of the game, including a visual indicator system operatively connected to each of said individual wagering fields of said player betting areas permitting the selective activation of one or more of said individual wagering fields, and a plurality of selectively actuatable switches operatively connected to said indicator system.

13. An apparatus for playing a wagering game as described in claim 12, and further comprising, an additional symbol for the game that is added to said plurality of symbols, said additional symbol not shown as an indicia on any of said plurality of individual wagering fields.

14. An apparatus for playing a wagering game as described in claim 12, wherein said playing surface includes indicia on said surface defining a plurality of separate, propositional fields that may be selectively used by players to indicate that a proposition bet has been placed.

15. A method of playing a wagering game whose outcome is determined by a selection of randomly generated symbols of that game comprising the steps of:

(a) selecting a first symbol from said selection of randomly generated symbols prior to the placement of any wagers, (b) providing a playing surface having defined thereon a plurality of player betting areas, each of said player betting areas including a plurality of individual wagering fields, said individual wagering fields having indicia thereon representing each of said selection of randomly generated symbols and together comprising an array of eligible wagering areas;

(c) eliminating said selected symbol from each of said individual wagering fields as an eligible wagering area;

(d) wagering on a chance occurrence of a specific symbol from said selection of random symbols being selected during the play of the game;

(e) randomly selecting one of said symbols from said selection of random symbols;

(f) settling of the wagers of the chance occurrence of said specific symbol based upon said random selection step;

(g) eliminating said specific symbol from each of said individual wagering fields as an eligible wagering area; and (h) repeating steps (d)–(g) until said first selected symbol is randomly selected.

16. A method of playing a wagering game a described in claim 15, wherein a house card having a special indicia defined thereon is provided in said selection of randomly generated symbols but not within any of said individual wagering fields, and further comprising:

(i) concluding the play of the game upon the random selection of said house card; and (j) forfeiting all wagers placed upon the random selection of said house card.

17. A method of playing a wagering game a described in claim 16, and further comprising:

(k) forfeiting all wagers placed on a specific one of said randomly selected symbols upon the occurrence of said specific one of said randomly selected symbol.

18. A method of playing a wagering game a described in claim 17, wherein said playing surface includes a plurality of individual, selectively actuatable illuminating sources, a separate one of said plurality of illuminating sources provided each individual wagering field, and where said eliminating steps comprise activating said illuminating source associated with the individual wagering field bearing the indicia of said symbol.

19. A method of playing a wagering game a described in claim 17, and further comprising:

(l) wagering on a chance occurrence of a first specific symbol from said selection of random symbols being selected during the first play of the game.

20. A method of playing a wagering game a described in claim 19, and further comprising:

(m) wagering on a chance occurence of a second specific symbol from said selection of random symbols being selected during the second play of the game provided said first specific symbol was randomly selected during the first play of the game.

21. A method of playing a wagering game a described in claim 20, and further comprising:

(n) wagering on a chance occurrence of a third specific symbol from said selection of random symbols being selected during the third play of the game provided said second specific symbol was randomly selected during the second play of the game.

* * * * *